US009404043B2

(12) United States Patent
Kim

(10) Patent No.: US 9,404,043 B2
(45) Date of Patent: Aug. 2, 2016

(54) AIR DISTRIBUTING DEVICE FOR PRIMARY AIR IN COKE OVENS

(75) Inventor: Ronald Kim, Essen (DE)

(73) Assignee: THYSSENKRUPP INDUSTRIAL SUOLUTIONS AG, Essen (DE)

( * ) Notice: Subject to any disclaimer, the term of this patent is extended or adjusted under 35 U.S.C. 154(b) by 690 days.

(21) Appl. No.: 12/998,315

(22) PCT Filed: Sep. 9, 2009

(86) PCT No.: PCT/EP2009/006527

§ 371 (c)(1),
(2), (4) Date: Apr. 7, 2011

(87) PCT Pub. No.: WO2010/040435

PCT Pub. Date: Apr. 15, 2010

(65) Prior Publication Data

US 2011/0192395 A1 Aug. 11, 2011

(30) Foreign Application Priority Data

Oct. 9, 2008 (DE) ..... 10 2008 050 599

(51) Int. Cl.
*F23C 7/00* (2006.01)
*C10B 15/02* (2006.01)
*C10B 21/10* (2006.01)

(52) U.S. Cl.
CPC ..... *C10B 15/02* (2013.01); *C10B 21/10* (2013.01)

(58) Field of Classification Search
CPC ..... C10B 21/18; C10B 15/02
USPC ..... 126/85 R
See application file for complete search history.

(56) References Cited

U.S. PATENT DOCUMENTS

| | | | | | |
|---|---|---|---|---|---|
| 1,058,550 | A | * | 4/1913 | Christie | 202/244 |
| 1,340,990 | A | * | 5/1920 | Still et al. | 209/238 |
| 1,341,437 | A | * | 5/1920 | Pershall | 208/130 |
| 1,352,338 | A | * | 9/1920 | Aarts | 202/139 |
| 1,352,696 | A | * | 9/1920 | Roberts | 201/10 |
| 1,369,673 | A | * | 2/1921 | Koppers | 201/38 |
| 1,395,061 | A | * | 10/1921 | Roberts | 202/248 |
| 1,399,594 | A | * | 12/1921 | Wilputte | 202/248 |
| 1,497,769 | A | * | 6/1924 | Bishop | 202/226 |
| 1,588,629 | A | * | 6/1926 | Smith | 432/31 |
| 1,650,126 | A | * | 11/1927 | Hall | 44/591 |

(Continued)

FOREIGN PATENT DOCUMENTS

| | | |
|---|---|---|
| CA | 2 724 813 A1 | 12/2009 |
| CN | 201100634 Y | 8/2008 |

(Continued)

*Primary Examiner* — Gregory Huson
*Assistant Examiner* — Martha Becton
(74) *Attorney, Agent, or Firm* — Lathrop & Gage LLP

(57) ABSTRACT

A device for introduction of primary combustion air into the primary heating space of a coke oven chamber admits primary air through ports in the top of a oven chamber or in the oven chamber walls above the door or in the chamber door or in several or all of the mentioned positions These ports have inserts that are equipped with spouts, with the spouts having an opening through which primary air is conducted at a chamfered angle onto the coke cake. The primary air from the opening ports in the coke oven chamber top streams to the coke oven at an angle of less than 90° and primary air from the opening ports in the chamber wall above the door or in the door streams to the coke oven at an angle of greater than 0°. Also shown is a method for use with the described device.

20 Claims, 4 Drawing Sheets

(56) References Cited

U.S. PATENT DOCUMENTS

| | | | | | |
|---|---|---|---|---|---|
| 1,755,027 | A | * | 4/1930 | Saha | 110/256 |
| 1,894,438 | A | * | 1/1933 | Bartholomew | 208/7 |
| 1,928,607 | A | * | 9/1933 | Van Ackeren | 202/142 |
| 2,091,702 | A | * | 8/1937 | Daniels | 202/98 |
| 2,255,406 | A | * | 9/1941 | Becker | 202/151 |
| 2,259,380 | A | * | 10/1941 | Hughes | 202/145 |
| 2,295,069 | A | * | 9/1942 | Zippler | 266/268 |
| 2,306,366 | A | * | 12/1942 | Becker | 202/142 |
| 2,306,678 | A | * | 12/1942 | Van Ackeren | 202/143 |
| 2,309,959 | A | * | 2/1943 | Hughes | 201/41 |
| 2,334,612 | A | * | 11/1943 | Davis | 202/141 |
| 2,376,718 | A | * | 5/1945 | Otto | 202/133 |
| 2,378,387 | A | * | 6/1945 | Becker | 202/143 |
| 2,480,459 | A | * | 8/1949 | Fletcher | 122/6.5 |
| 2,488,175 | A | * | 11/1949 | Davis | 202/151 |
| 2,516,929 | A | * | 8/1950 | Van Ackeren | 202/151 |
| 2,540,002 | A | * | 1/1951 | Mason | 406/38 |
| 2,620,967 | A | * | 12/1952 | Worn | 417/158 |
| 2,623,846 | A | * | 12/1952 | Robert | 202/142 |
| 2,640,805 | A | * | 6/1953 | Hughes | 202/102 |
| 2,974,090 | A | * | 3/1961 | Schmidt | 201/41 |
| 3,046,096 | A | * | 7/1962 | Heller et al. | 423/455 |
| 3,224,749 | A | * | 12/1965 | Berry | C21C 5/4606 122/6.6 |
| 3,275,721 | A | * | 9/1966 | Leroy et al. | 264/642 |
| 3,398,671 | A | * | 8/1968 | Acosta | 454/36 |
| 3,847,752 | A | * | 11/1974 | Oleszko et al. | 201/32 |
| 3,932,173 | A | * | 1/1976 | Collin et al. | 75/10.15 |
| 4,045,299 | A | * | 8/1977 | MacDonald | 202/93 |
| 4,117,773 | A | * | 10/1978 | Johnson | 454/64 |
| 4,124,450 | A | * | 11/1978 | MacDonald | 201/15 |
| 4,141,797 | A | * | 2/1979 | Pries et al. | 201/41 |
| 4,157,940 | A | * | 6/1979 | Watson | 201/1 |
| 4,222,824 | A | * | 9/1980 | Flockenhaus et al. | 201/41 |
| 4,351,632 | A | * | 9/1982 | Nagai | 431/183 |
| 4,435,152 | A | * | 3/1984 | Struck et al. | 431/170 |
| 4,439,401 | A | * | 3/1984 | Voll et al. | 422/150 |
| 4,482,314 | A | * | 11/1984 | Giese et al. | 432/11 |
| 4,515,094 | A | * | 5/1985 | Azuhata et al. | 110/347 |
| 4,599,140 | A | * | 7/1986 | Bauer | 201/1 |
| 4,726,761 | A | * | 2/1988 | Binasik et al. | 431/9 |
| 4,784,810 | A | * | 11/1988 | Jorzyk et al. | 261/17 |
| 4,823,710 | A | * | 4/1989 | Garrido et al. | 110/234 |
| 5,013,408 | A | * | 5/1991 | Asai et al. | 202/241 |
| 5,191,930 | A | * | 3/1993 | Chaney | 165/4 |
| 5,318,671 | A | * | 6/1994 | Pruitt | 201/1 |
| 5,322,026 | A | * | 6/1994 | Bay, II | 110/235 |
| 5,505,762 | A | * | 4/1996 | Denholm et al. | 75/641 |
| 5,829,967 | A | * | 11/1998 | Chyou | 431/350 |
| 6,187,148 | B1 | * | 2/2001 | Sturgulewski | 202/258 |
| 6,440,356 | B2 | * | 8/2002 | Dunne | 266/225 |
| 6,773,659 | B2 | * | 8/2004 | Dunne et al. | 266/225 |
| 6,932,854 | B2 | * | 8/2005 | Riley et al. | 75/544 |
| 2004/0099011 | A1 | * | 5/2004 | Hegewald et al. | 65/136.3 |
| 2008/0041189 | A1 | * | 2/2008 | Brotzmann | 75/401 |
| 2009/0152092 | A1 | | 6/2009 | Kim et al. | |
| 2010/0025217 | A1 | | 2/2010 | Schuecker et al. | |
| 2010/0300867 | A1 | | 12/2010 | Kim et al. | |
| 2011/0101576 | A1 | * | 5/2011 | Cho et al. | 266/47 |

FOREIGN PATENT DOCUMENTS

| | | | |
|---|---|---|---|
| DE | 81916 | C | 7/1895 |
| DE | 10 2005 015 301 | A1 | 10/2006 |
| DE | 10 2007 042 502 | A1 | 3/2009 |
| DE | 10 2008 025 437 | A1 | 12/2009 |
| EP | 1 893 721 | A1 | 3/2008 |
| GB | 341 157 | A | 1/1931 |
| WO | WO 2007/057076 | A1 | 5/2007 |
| WO | WO 2009/143948 | A1 | 12/2009 |

* cited by examiner 11a
14
1a
4
11
4
11b
13b
6
12
4b
β'
13
13a
4

9
10
5
7
6
8
Z
1
Z
6
6
14
4

AIR DISTRIBUTING DEVICE FOR PRIMARY AIR IN COKE OVENS

BACKGROUND OF THE INVENTION

The invention relates to a device for a directed supply of primary combustion air into the coking chamber of a coke oven of the "Non-Recovery" or "Heat-Recovery" type, wherein primary combustion air is ducted through one or several entry ports in the coke oven top or in the front-end or rear-end coke oven chamber wall, and wherein the entry port(s) is (are) equipped with devices through which the entry stream of primary air is directed so that the primary air is better distributed in the gas-filled space over the coke cake. The invention also relates to a method for operating a coke oven chamber or coke oven battery or coke oven bank, wherein the primary combustion air for coal carbonization enters through one or several entry port(s) in the top of a coke oven chamber or through one or several entry port(s) in the coke oven chamber wall of a coke oven or through one or several entry port(s) in the coke oven chamber door of a coke oven chamber into the gas-filled space above the coke cake, with the coking gas from coal carbonization utilized for combustion also being ducted into said gas-filled space, and wherein the primary air streams to the coke cake at an angle of less than 90° in vertical direction and at an angle of more than 0° in horizontal direction.

Production of coke from coal or carbonaceous materials is frequently performed in coke ovens of the "Non-Recovery" or "Heat-Recovery" type. With coke ovens of the "Non-Recovery" or "Heat-Recovery" type, coal is heated to high temperatures, and the evolving coking gas is combusted with an under-stoichiometric quantity of so-called primary air. In general, combustion with primary air is incomplete and occurs in a gas-filled space above the coke cake, which is called the primary heating space. Proceeding from this gas-filled space, the incompletely burnt coking gas is ducted into so-called "downcomer" channels into secondary air soles located beneath the coking chamber where secondary air streams in and where the incompletely burnt coking gas is completely combusted. In this manner, a more uniform heat distribution of the entire coke cake is achieved. With the "Heat-Recovery" type, the heat from combustion is additionally exploited to generate energy.

In general, the introduction of primary air into the primary heating chamber is accomplished through openings in the top of a coke oven chamber or in the vertical coke oven chamber wall which is located above the coke oven chamber door. In a frequently encountered layout, the coke oven chambers are closed by coke oven chamber doors which are mounted at the front-end coke oven chamber wall, which is also called pusher side coke oven chamber wall, as well as at the rear-end frontal coke oven chamber wall, which is also called coke side coke oven chamber wall, in order to allow for charging and cleaning of a coke oven chamber. To minimize heat losses during charging, the doors of coke oven chambers are so mounted that they only seal the coke oven chamber bottom section which is charged with the coke cake. The upper section of the coke oven chamber which in its interior encompasses the gas-filled space is covered externally at the frontal walls by the coke oven chamber wall. In a typical layout, this part of the coke oven chamber walls which is located above the coke oven chamber doors is comprised of openings which—in addition to the openings in the top of the coke oven chamber—are utilized for introducing primary air into the gas-filled space above the coke cake.

Likewise, there are prior art layouts for coke oven chambers, the frontal coke oven chamber door of which closes the entire coking space and, more particularly, the gas-filled space in the interior of the coke oven chamber towards the exterior. The coke oven chamber door then encompasses nearly the entire frontal coke oven chamber wall. This may be the case both on the pusher side and coke side frontal coke oven chamber walls as well as on both sides. Entry ports for primary air may also be located in the doors of these layouts.

The German patent description DE 102008025437.1 which has not yet been disclosed at the moment of this application describes a device which is utilized for a directed introduction of primary air into the gas space of a coke oven chamber, with said device being comprised of openings launched into the top of a coke oven chamber and with these openings having an opening-outwardly directed stream-out angle relative to a vertical plumb through the top, said angle being an opening angle and being greater than 0°. Owing to this shape, primary air is better distributed in the gas space above the coke oven so that the combustion of coking gas in this area is improved. Though the teaching allows for an intensified intimate mixing of primary air and coking gas in the area of the gas space lying over the coke cake and being near the entry port, there is some need for improvement relative to a further intensified intimate mixing of primary combustion air and coking gas in the gas space areas further away from the entry ports.

Opening ports for supply of primary air frequently are so designed that they admit primary air vertically onto the coke cake without any further distribution into the gas-filled primary heating chamber or horizontally without any further conduction or direction onto the coke cake, if the primary air streams in laterally. This causes a non-uniform distribution of primary air in the gas-filled space above the coke oven chamber whereby the partial combustion of coking gas with primary air takes a worse course and whereby the temperature distribution in the upper part of the coke oven chamber becomes non-uniform. This entails a substantially increased burden of gases containing nitric oxides of the $NO_x$ type on combustion of coking gas with primary air.

In some layouts of coke ovens, a fan is installed into the air supply openings for coal in order to support the air admittance of primary air into the combustion gas space. An example is taught by GB 341157 A. Other designs, in turn, utilize an air supply system that collects the air for a coke oven battery or a coke oven bank and feeds it in dosed quantities to each individual coke oven. For example, this can be accomplished by suitable control elements or regulating elements in the individual air supply ducts for the individual coke oven chambers. In this manner, the supply of air is made independent of weather impacts. An example is taught by EP 1893721 A1. However, the layouts and designs outlined hereinabove merely alter the efficiency of the outer air supply for coke ovens while they do not solve the problem of an insufficient air distribution in the opening-remote areas of the combustion space above the coke cake.

BRIEF SUMMARY OF THE INVENTION

Now, therefore, it is the object to provide a device that allows for an improved air distribution for primary combustion air into the primary heating chamber in the area of the gas space above the coke cake. The device should take effect, if possible, in the interior area of the gas space superposing the coke cake in order to allow for an optimized combustion of coking gas over the entire area of the coke cake. By way of an improved air supply in the inner area of said gas space, too, it is possible to improve the area heating on the bed surface of the gas space where the heat of combustion can distribute itself over the entire coke cake. Furthermore, an optimized combustion will diminish the formation of contaminants, more particularly of gases containing nitric oxides that evolve from combustion.

It is an object of the present invention to allow for the admittance of air both over the top of the coke oven and through the coke oven chamber walls or through the coke oven chamber doors. Depending on the embodiment of the invention, it should also be possible to feed primary air optionally through openings in the top of a coke oven chamber as well as in the chamber walls or doors of the coke oven chamber. It is also an object of the present invention to allow for feeding primary air through an air distribution system by way of which all or several coke oven chambers of a coke oven battery or coke oven bank can be approached, or with an air distribution system that admits the primary air individually into the coke oven chambers of coke oven batteries or coke oven banks.

The present invention solves this task by a feeding device for primary combustion air which is installed into the entry ports for primary air of coke ovens and which is comprised of spouts located at the oven-inwardly directed sides, with the primary air being conducted in bundled form and in form of an angularly directed primary air stream through said spouts into the interior of the gas-filled space superposing the coke cake of a coke oven chamber. The feeding device is preferably configured as an insert that can be installed into the entry ports for primary air and which can be built-in, depending on requirements, in any number into the top or into the coke oven chamber wall above the coke oven chamber door or into the coke oven chamber door or into several or into all of these positions.

Through the inventive insert with the inventive spouts, primary air streams at the coke cake in vertical direction at an angle ($\beta$) of less than 90° and in horizontal direction at an angle ($\beta'$) of more than 0°.

Claim is also laid in particular to a device for feeding primary air for the combustion of coking gas into the coking chamber of a coke oven of a coke oven battery of the "Non-Recovery" or "Heat-Recovery" type, wherein one or several entry ports for primary air for each coke oven chamber are located separately or through an air supply system in the top or in the coke oven chamber wall above the coke oven chamber door or in a coke oven chamber door of each coke oven chamber frontally closing the gas space existing above the coke cake in such a manner that the primary air enters into the gas-filled space existing above the coke cake, with the coking gas evolving during coal carbonization also entering into said gas-filled space, and wherein the primary air is brought in contact with the coking gas through these opening ports, and which is characterized in that at least one of the entry ports in the top comprises an insert which is built-in into the entry ports and which comprises at least two spouts at the oven-inwardly directed side, said spouts having an oven-outwardly directed angle of more than 0° relative to a perpendicular plumb through the top, or at least one of the entry ports in the coke oven chamber wall above the coke oven door comprises an insert which is built-in into the entry ports and which comprises at least two spouts at the oven-inwardly directed side, said spouts having an oven-outwardly directed angle of more than 0° relative to a perpendicular plumb through the lateral coke oven chamber wall above the coke oven door, or at least one of the entry ports in the coke oven chamber door which frontally closes the gas space above the coke cake comprises an insert which is built-in into the entry ports and which comprises at least two spouts at the oven-inwardly directed side, said spouts having an oven-outwardly directed angle of more than 0° relative to a perpendicular plumb through the lateral coke oven chamber door.

The device may also be so configured that entry ports are located both in the top of the coke oven chamber and in the coke oven chamber wall above the coke oven chamber door as well as in the coke oven chamber door which frontally closes the gas space above the coke cake, with primary air entering through said entry ports into the gas-filled space existing above the coke cake and being brought there in contact with the coking gas, and that at least one of the entry ports is equipped with the inventive inserts. In principle, the entry ports may be located at any of the mentioned positions in the coke oven chamber, in any number or in any combination.

In a typical embodiment, the device is comprised of a cylindrical insert made of a heat-resistant material and embedded and fastened in the brickwork of the coke oven top or coke oven chamber wall existing above the coke oven chamber door. This can be accomplished by embedding it in the brickwork or by fastening it with splints. The insert is preferably cylindrical but it may also be of a parallelepiped shape or nearly cylindrical. After all, the shape of the insert is arbitrary, provided it allows for the inventive implementation of a bordering into the coke oven chamber wall or provided it is suitable for bordering of spouts.

The insert may also be chamfered at the sides so that it can be embedded into a bordering bricked-up in opposite direction in the coke oven chamber wall. As a result hereof, it can be exchanged or taken-out, for example, depending on the operational requirements of the cokemaking process. For instance, this can be done prior to or after the beginning of a cokemaking cycle, but also during operation, depending on the operational requirements.

For the implementation of the present invention, it is also possible to equip only one entry port with an inventive insert, considering a plurality of inserts. The number and arrangement of inserts depends on the ventilation requirement of a specific coke oven chamber.

In one embodiment of the present invention, the inserts on the oven-outwardly directed side are provided with covers that protect the entry ports with the inventive openings against weather impacts. This is particularly the case if the entry ports supply each oven individually with air from the outside. However, depending on the layout, this may also be the case with an air supply system for a coke oven battery. In another embodiment of the present invention, the cover over the entry ports is comprised of U tubes seated above the entry port and offering protection against the exterior atmosphere by means of the U-shaped bending, if the entry port is situated in the top of the coke oven chamber. Conversely, if the entry port is situated in the frontal coke oven chamber wall above the coke oven chamber or in the coke oven chamber door, then for example the cover my also be an extended oven-outwardly directed tube.

In the interior, the U tube or the cover may be comprised of a device through which the admittance of air can be controlled. This device may also be mounted on the opening of the U tube or at any arbitrary position. Devices for controlling and regulating the admittance of air are known from prior art in technology. An example for controlling devices for the admittance of air is taught by WO 2007057076 A1. The regulating system for the control mechanism for the admitted quantity of primary air can be driven arbitrarily. In a simple form, it can be driven by a manually operated chain, and in another embodiment it can also be driven by an actuator motor, for example.

Spouts for a directed introduction of primary combustion air can be shaped arbitrarily. For example, they may be of a quadratic shape in their cross section or they may also be round. In a preferred embodiment, they are round in their cross section and constitute a cylindrically shaped continuation of the inventive insert, said continuation being shaped as a channel and directed into the oven interior. In one embodiment, it has an angle ($\alpha$) of 1° to 35° relative to a longitudinally directed plumb through the center of the insert. In a preferred embodiment of the present invention, the spouts have an angle ($\alpha$) of 15° to 25° relative to a longitudinally directed plumb through the insert. For inserts in the top of a coke oven, the plumb relates to a perpendicular vertical plumb in the coke oven top; for inserts in the frontal lateral coke oven chamber wall above the coke oven door, the plumb relates to a horizontal plumb through the coke oven chamber wall.

In a preferred embodiment of the present invention, the inserts installed into the brickwork of the coke oven chamber top or coke oven chamber wall are of a cylindrical shape. But they may also be of a parallelepiped or conical shape. The entry port into the coke oven chamber top or into the coke oven chamber wall is typically adapted to the insert.

In an advantageous embodiment, the length of the spouts accounts for 70 to 500 mm. Typically, the lengths of the spouts amount to 300 mm. The number of spouts per entry insert may also be arbitrary. For example, it may range between 1 and 6 spouts. In a preferred embodiment, the number of spouts per insert amounts to four. The cross section of the inner gas-carrying spout tube has a size that allows for installing the utilized number of spouts. The cross section of the inner gas-carrying spout tube typically ranges between 1500 and 15000 $mm^2$. The cross section of the inner gas-carrying spout tube may have an arbitrary shape. Preferably it is of a round shape. With a round shape, the inner diameter of the gas-carrying spout tube preferably has a diameter of 70 to 500 mm at the level of the opening and insert bordering, and even more preferably amounts to 100 mm.

To allow for a reasonable gas inflow velocity, the inventive spouts have a preferred length vs. diameter ratio. It typically lies at 1 to 20. In a particularly preferred embodiment, the length vs. diameter ratio is greater than 2. To allow for a reasonable gas flow velocity, it is also feasible to equip the inventive insert with elements that increase the tangential gas flow velocity. For example, if it is intended to increase the gas flow velocity, these elements may be Venturi elements. With a desired deceleration of the gas flow, these elements may also be flaps. These elements may also be controllable. With a desired broadening of the gas flow, the Venturi elements may be inclined accordingly. To increase the tangential gas flow velocity, the inventive device may also be comprised of a fan mounted at any arbitrary position.

The inventive device is so manufactured that it can resist high temperatures, particularly those prevailing in the interior of a coke oven chamber. Particularly suitable materials for manufacture are ceramics, silica, shot concrete, fireclay bricks or a high temperature resistant steel. The inventive insert can also be manufactured from different input materials. For example, the encompassing insert may be manufactured from ceramics, while the spouts may be manufactured from high temperature resistant steel. The insert with the spouts can be manufactured in any arbitrary manner. For example, the processes applied may be pressing or casting processes. The insert and the spouts can also be manufactured from different materials. If the spout is made of a material that differs from the material utilized for the insert, then the spout is preferably made of a high alumina material in a casting process and it distinguishes itself by specific densities greater than 2.5 $g/cm^3$. The spouts thus manufactured are acid-proof and resist to coking gases containing sulfuric oxides.

Claim is also laid to a method for feeding primary combustion air into the coke oven chamber of a coke oven battery or a coke oven bank. Accordingly, primary air is supplied through the entry ports in the upper area of the coke oven, with it being possible to supply this air both separately into each entry port and through a centralized air supply system. For the implementation of the inventive method, it does not matter whether the supplied primary combustion air has atmospheric temperatures or whether it is heated or cooled.

Claim is also laid in particular to a method for feeding combustion air for the combustion of coking gas into a coking chamber of a coke oven of the "Non-Recovery" or "Heat Recovery" type, wherein primary air streams into the coke oven chamber through one or several entry ports in the top of a coke oven chamber or in the frontal pusher side or coke side coke oven chamber wall above the coke oven chamber door or in the coke oven chamber door frontally closing the gas space existing above the coke cake, with the coking gas evolving during coal carbonization entering into said gas-filled space existing above the coke cake where the coking gas is brought in contact with the primary air through the opening ports, and which is characterized in that primary air streams at the coke cake through devices conducting the gas stream in entry ports comprised of said inserts which have the shape of spouts vertically relative to a perpendicular plumb through the top of the coke oven chamber at an angle greater than 0° and horizontally relative to a perpendicular plumb through the lateral coke oven chamber wall at an angle of less than 90°.

The inventive method may also include for exchanging or taking-out the inventive inserts with the spouts. The exchange of the inventive insert can be performed prior to, during or after a coal carbonization cycle. The moment of exchange and the duration basically depend on operational requirements.

The inventive device and the method executed thereby have the advantage of a directed supply of primary combustion air into the interior of a coke oven chamber gas-filled space superposing the coke cake. By way of the inventive device, the distribution of primary air over the entire space of the gas-filled space above the coke oven chamber is substantially improved. It leads to an improved distribution of the coking temperature above the entire coke cake and thus to a substantially improved quality of coke. Finally, the formation of contaminants in primary combustion of coking gas and more particularly the formation of nitric oxides of the $NO_x$ type, too, is substantially reduced by the inventive execution of this method.

The inventive embodiment of a device for generating of gases is explained in greater detail by way of four drawings, with the inventive method not being restricted to these embodiments.

DETAILED DESCRIPTION OF THE INVENTION

Figure 1:
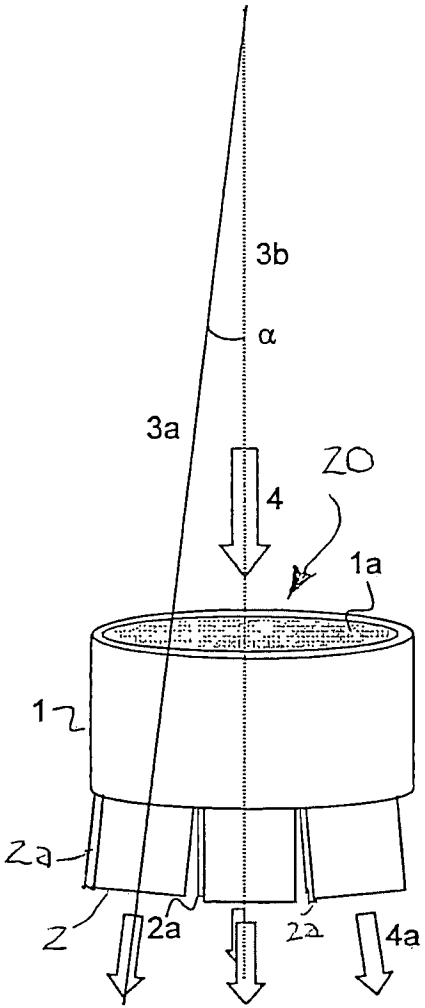
FIG. 1 shows an inventive insert comprised of four downwardly pointing spouts.

FIG. 1 shows an inventive insert (1) which is equipped with six spouts (2) on its lower side. Three of these spouts (2*a*) are visible in concealed form only. The spouts (2) are oven-inwardly directed and in their oven-outward direction they have an angle α (3*a*) greater than 0°, relative to a plumb (3*b*) through the coke oven top. Primary air (4) streams through the upper side into the insert and leaves it at a directional angle (4*a*). To increase the tangential gas flow velocity, the inventive device may also be comprised of a fan (20) mounted at any arbitrary position, in this case within the insert (1) for the supply of primary air.

Figure 2:
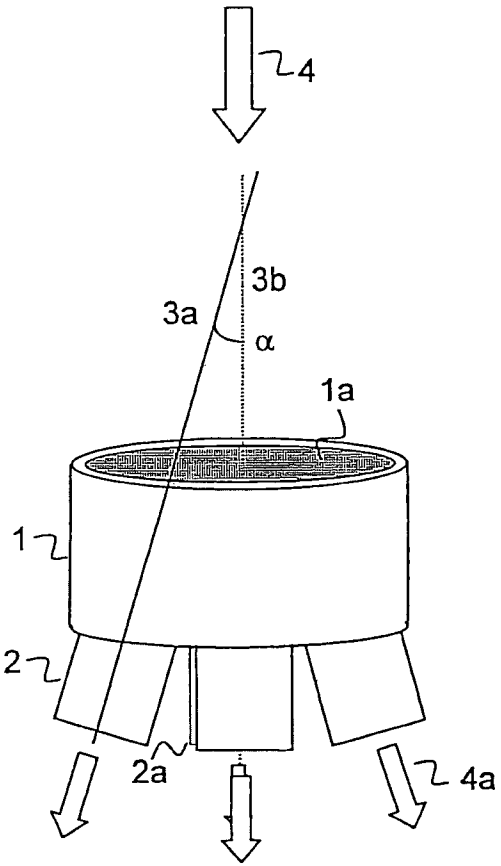
FIG. 2 also shows an inventive insert which is also comprised of four downwardly pointing spouts, which however have a broadened outlet angle.

FIG. 2 also shows an inventive insert (1) which is equipped with four spouts (2) on its lower side. The oven-outwardly directed angle α (3*a*), relative to a plumb (3*b*) through the coke oven top, is substantially greater so that primary air (4*a*) streams at the coke cake from the top at a substantially broader angle.

Figure 3:
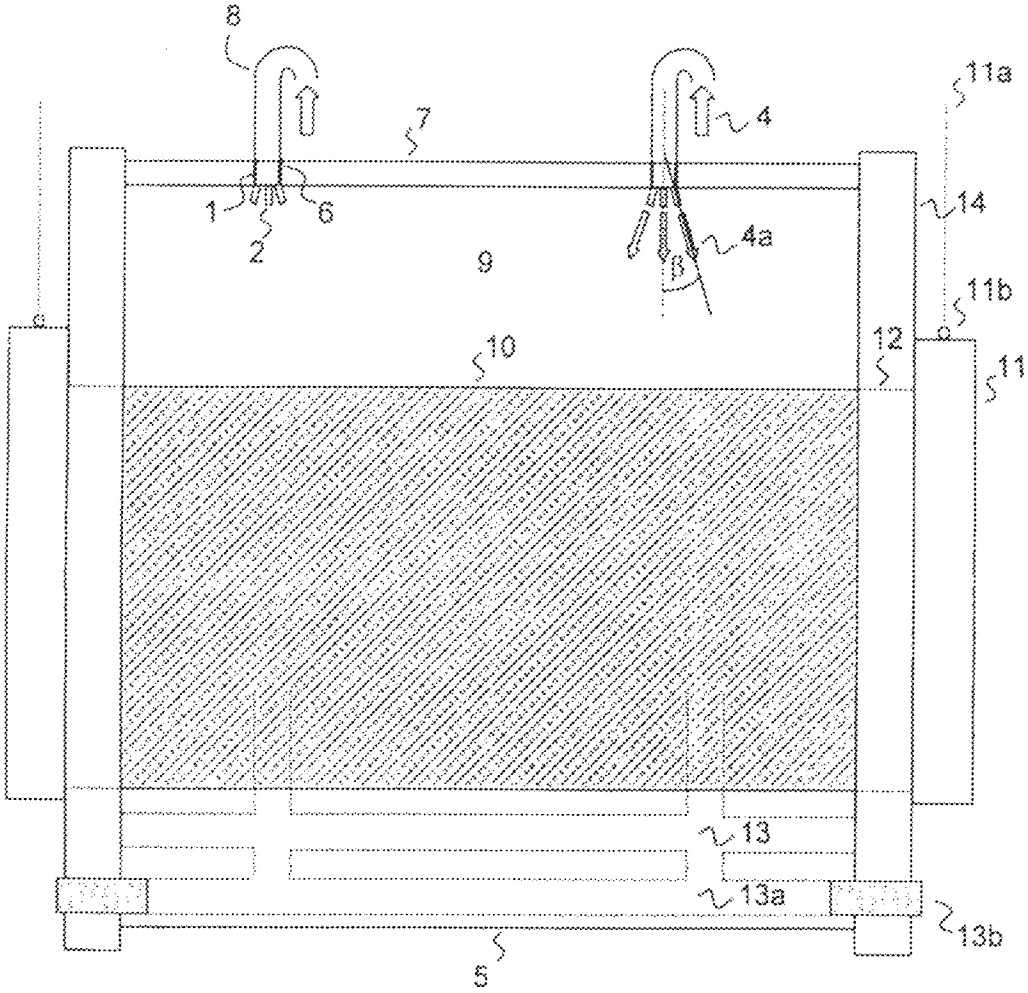
FIG. 3 shows a coke oven chamber which is equipped with the inventive inserts in the top of the coke oven chamber.

FIG. 3 shows a coke oven chamber (5), comprised of two inventive inserts (1) in the opening ports for primary air (6) in the top of the coke oven chamber (7). On the upper oven-outwardly directed side of the inserts (1), they are equipped with U tube shaped set-up attachments (8) that protect the opening ports for primary air (6) against weather impacts. Via these U tubes, primary air (4) is introduced through the entry ports for primary air (6) which are equipped with the inventive inserts (1) into the coking chamber (9). The inserts (1) are comprised of the inventive spouts (2) through which primary air is not conducted at a 90° angle but at a chamfered vertical inflow angle (β) rather than vertically onto the coke cake (10) (4*a*). As a result hereof, the intimate mixing of coking gas and primary air in the primary heating space (9) is substantially improved. To be seen here, too, are the coke cake (10), the coke oven chamber doors (11) with the opening port pull device (11*a*) and holding device (11*b*), opening ports leading to the coke oven chamber (12) and located downstream thereof in oven-inward direction, the secondary heating space (13) and the secondary air sole (13*a*) with the associated secondary air opening ports (13*b*).

Figure 4:
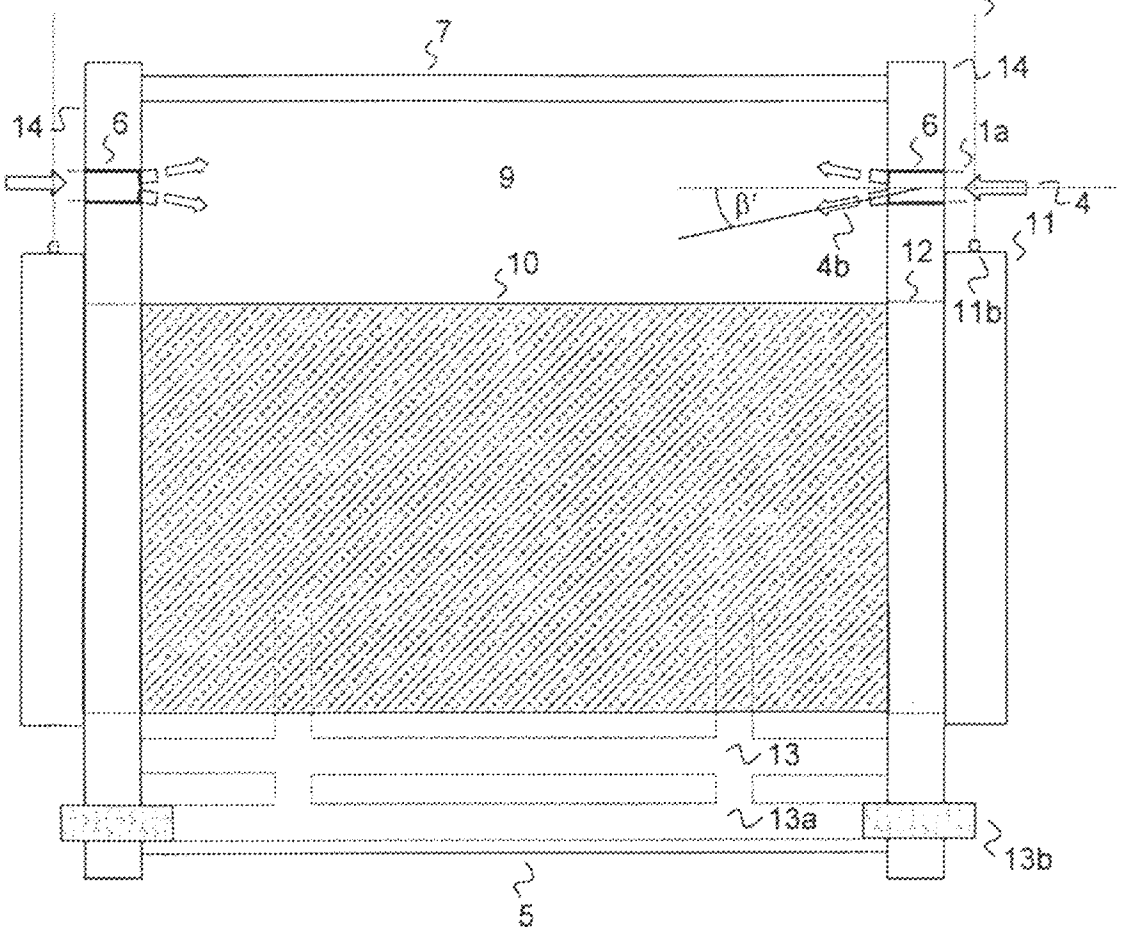
FIG. 4 shows a coke oven chamber which is equipped with the inventive inserts in both frontal coke oven chamber walls.

FIG. 4 shows a coke oven chamber (5), comprised of two inventive inserts (2) in the frontal coke oven chamber wall (14) above the coke oven chamber door (11). In the frontal coke oven chamber wall (14), there are two of the inventive inserts (1) situated both in the frontal pusher side and frontal coke side coke oven chamber wall above the coke oven chamber door (11), viewed in the plane of the paper. Further inventive inserts may be located outside the plane of the paper. In oven-inward direction, they are equipped with the inventive spouts (2). Primary air (4) is introduced through these opening ports for primary air (6) equipped with the inventive inserts (2) into the primary heating space of the coking chamber (9) above the coke cake (10). By way of the inventive spouts (2) primary air (4) is not introduced at an angle of 0° to the surface of the coke, but it streams at a chamfered horizontal inflow angle (β') (4*b*) rather than in parallel to it. On their oven-outwardly directed side, the inventive inserts (1) may also be comprised of set-up attachments (1*a*) for protection against weather impacts. To be seen here, too, are the coke cake (10), the coke oven chamber doors (11) with the opening port hoisting device (11*a*) and holding device (11*b*), opening ports leading to the coke oven chamber (12) and located downstream thereof in oven-inward direction, the secondary heating space (13) and the secondary air sole (13*a*) with the associated secondary air opening ports (13*b*).

Figure 5:
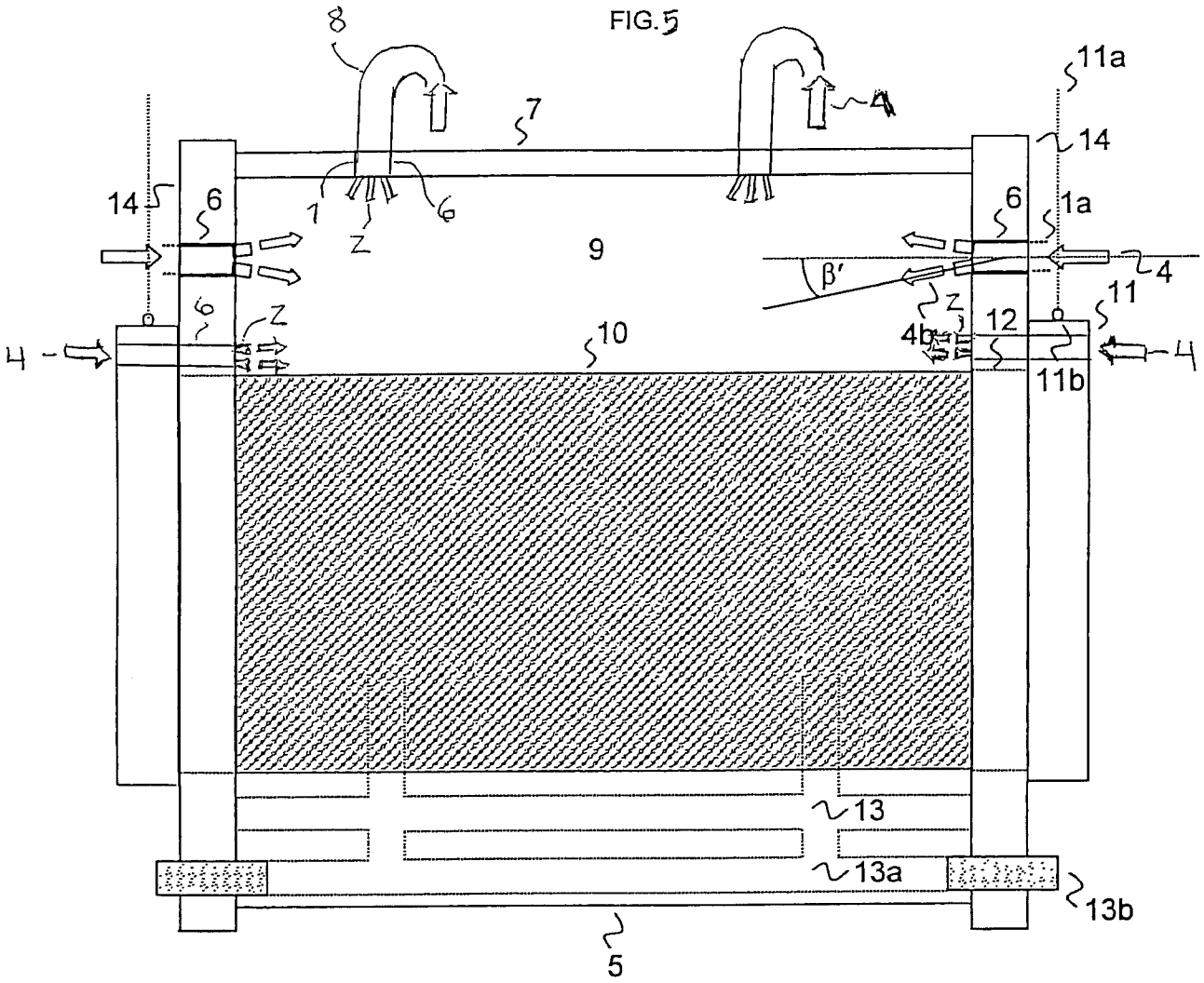
FIG. 5 shows a coke oven chamber with openings in the walls, top and door.

FIG. 5 shows a similar view to the oven of FIG. 1, but shows opening ports (6) in each of the door (11), wall (14) and top (7) of the coke oven chamber (5).

LIST OF REFERENCE SYMBOLS

1 Inserts
1*a* Set-up attachments for protection against weather impacts
2 Spouts
2*a* Concealed spout
3*a* Opening-outwardly directed angle of the spout
3*b* Plumb through the coke oven top
4 Primary air stream
4*a* Vertically directed chamfered primary air stream
4*b* Horizontally directed chamfered primary air stream
5 Coke oven chamber
6 Opening ports for primary air
7 Top of the coke oven chamber
8 U-tube shaped set-up attachments
9 Primary heating space
10 Coke cake
11 Coke oven chamber door
11*a* Hoisting device for coke oven chamber door
11*b* Holding device for the hoisting device
12 Opening port towards the coke oven chamber
13 Secondary heating space
13*a* Secondary air sole
13*b* Secondary air opening ports
14 Frontal coke oven chamber wall
20 Fan
α Opening-outwardly directed angle of the spouts
β Vertical inflow angle of primary air
β' Horizontal inflow angle of primary air

The invention claimed is:

1. A device for feeding of primary combustion air for the combustion of coking gas into the coking chamber of a coke oven of a coke oven battery of the "Non-Recovery" or "Heat-Recovery" type, wherein the coke oven comprises a top and a wall, the coke oven top and wall defining a coke oven chamber for loading a coke cake, the oven further comprising a door disposed within the coke oven chamber wall; wherein one or several entry ports for feeding primary air into the coke oven chamber separately or through an air supply system are located in the top or in the coke oven chamber wall above the coke oven chamber door or in the coke oven chamber door which from a front side closes a gas space existing above the coke cake of the coke oven chamber in such a manner that the primary air enters into the gas-filled space existing above the coke cake, where the coking gas emerging during coal carbonization also enters into said gas-filled space, and the primary air comes in contact with the coking gas through these entry ports; wherein at least one of the entry ports in the top comprises an insert which is incorporated into the entry port and on its side toward the oven at least two spouts are disposed, said spouts having an oven-outwardly directed angle of more than 0° relative to the perpendicular axis through the top; or at least one of the entry ports in the coke oven chamber wall above the coke oven door comprises an insert which is incorporated into the entry port and on its side toward the oven at least two spouts are disposed, said spouts having an oven-outwardly directed angle of more than 0° relative to the perpendicular axis through the lateral coke oven chamber wall above the coke oven door; or at least one of the entry ports in the coke oven chamber door which from the front side closes the gas space above the coke cake comprises an insert which is incorporated into the entry port and on its side toward the oven at least two spouts are disposed, said spouts having an opening-outwardly directed angle greater than 0° relative to the perpendicular axis through the lateral coke oven chamber door.

2. The device according to claim 1, wherein entry ports are located both in the top of the coke oven chamber and in the coke oven chamber wall above the coke oven chamber door through which primary air enters into the gas-filled space existing above the coke cake and comes there in contact with the coking gas, and that at least one of the entry ports is equipped with the inserts.

3. The device according to claim 1, wherein entry ports are located both in the top of the coke oven chamber and in the coke oven chamber door which from the front side closes the gas space above the coke cake, with primary air entering through these entry ports into the gas-filled space existing above the coke cake and coming there in contact with the coking gas, and that at least one of the entry ports is equipped with the inserts.

4. The device according to claim 1, wherein entry ports are located both in the top of the coke oven chamber wall above the coke oven chamber door and in the coke oven chamber door which from the front side closes the gas space above the coke cake, with primary air entering through these entry ports into the gas-filled space existing above the coke cake and coming there in contact with the coking gas, and that at least one of the entry ports is equipped with the inserts.

5. The device according to claim 1, wherein entry ports are located both in the top of the coke oven chamber and in the coke oven chamber wall above the coke oven chamber door as well as in the coke oven chamber door which from the front side closes the gas space above the coke cake, with primary air entering through said entry ports into the gas-filled space existing above the coke cake and coming there in contact with the coking gas, and that at least one of the entry ports is equipped with the inserts.

6. The device according to claim 1, wherein the entry ports for primary air and the inserts located in the top of the coke oven chamber are of a cylindrical shape.

7. The device according to claim 1, wherein the entry ports for primary air located in the top of the coke oven chamber have a U tube shaped cover on the oven-outwardly directed side of the top.

8. The device according to claim 7, wherein the U tube shaped cover is comprised of a device that controls the entering stream of primary air.

9. The device according to claim 1, wherein the spouts have an opening-outwardly directed angle of 1 to 35° with respect to the perpendicular axis through the top of the coke oven chamber or with respect to the perpendicular axis through the lateral coke oven chamber wall.

10. The device according to claim 9, wherein the spouts have an opening-outwardly directed angle of 15° to 25° relative to the perpendicular axis through the top of the coke oven chamber or relative to the perpendicular axis through the lateral coke oven chamber wall.

11. The device according to claim 1, wherein there is a position defined wherein the inserts border the opening, and the inserts have a cylindrical shape, and the opening and the insert border have a diameter of 70 to 500 mm.

12. The device according to claim 1, wherein each insert is comprised of 2 to 6 spouts.

13. The device according to claim 12, wherein each insert is comprised of 4 spouts.

14. The device according to claim 1, wherein each spout has an opening cross section of 1500 to 15000 $mm^2$.

15. The device according to claim 1, wherein the inserts for supply of primary air are in the form of twisting elements or Venturi elements that broaden the gas stream or increase the tangential gas velocity component.

16. The device according to claim 1, wherein a fan is located in the inserts for supply of primary air.

17. The device according to claim 1, wherein the device for supply of primary air is wholly or partly made of high heat-resistant steel, ceramics, shot concrete, high alumina material, silica, fireclay bricks or a combination of these construction materials.

18. The device according to claim 17, wherein the spouts of the inserts are wholly or partly made of high heat-resistant steel, ceramics, shot concrete, high alumina material, silica or fireclay bricks or a combination of these construction materials.

19. The device according to claim 17, wherein the device and particularly the inserts are manufactured by applying a casting or pressing process.

20. A method for the supply of primary combustion air for the combustion of coking gas into the coking chamber of a coke oven of the "Non-Recovery" or "Heat-Recovery" type, wherein:

said coke oven comprises a top and a wall, the coke oven top and wall defining a coke oven chamber therein for loading a coke cake, the oven further comprising a door disposed within the coke oven chamber wall; and said coke oven further comprises one or several entry ports for feeding primary air into the coke oven chamber separately or through an air supply system, wherein the entry ports are located in the top or in the coke oven chamber wall above the coke oven chamber door or in the coke oven chamber door of each coke oven chamber; and at least one of the entry ports in the top of said coke oven comprises an insert which is incorporated into the entry port and on its side toward the oven at least two spouts are disposed, said spouts having an oven-outwardly directed angle of more than 0° relative to the perpendicular axis through the top; or at least one of the entry ports in the coke oven chamber wall of said coke oven above the coke oven door comprises an insert which is incorporated into the entry port and on its side toward the oven at least two spouts are disposed, said spouts having an oven-outwardly directed angle of more than 0° relative to the perpendicular axis through the lateral coke oven chamber wall above the coke oven door; or at least one of the entry ports in the coke oven chamber door of said coke oven which from the front side closes the gas space above the coke cake comprises an insert which is incorporated into the entry port and on its side toward the oven at least two spouts are disposed, said spouts having an opening-outwardly directed angle greater than 0° relative to the perpendicular axis through a lateral coke oven chamber door; wherein primary air streams into the coke oven chamber through one or several entry ports in the top of a coke oven chamber or in a frontal pusher side or a coke side coke oven chamber wall above the coke oven chamber door or in the coke oven chamber door which from the front side closes the gas space existing above the coke cake, with the coking gas evolving during coal carbonization entering into a gas-filled space existing above the coke cake where the coking gas is brought in contact with the primary air through opening ports; the method comprising streaming primary air at the coke cake through devices conducting the gas stream in entry ports comprised of said inserts which are in the form of spouts vertically relative to the perpendicular axis through the top of the coke oven chamber at an angle less than 90° and horizontally relative to the perpendicular axis through the lateral coke oven chamber wall at an angle greater than 0°.

* * * * *